US010894265B2

(12) United States Patent
Hayashi

(10) Patent No.: US 10,894,265 B2
(45) Date of Patent: Jan. 19, 2021

(54) LIQUID DISCHARGE HEAD AND LIQUID DISCHARGE APPARATUS

(71) Applicant: BROTHER KOGYO KABUSHIKI KAISHA, Nagoya (JP)

(72) Inventor: Hideki Hayashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/543,895

(22) Filed: Aug. 19, 2019

(65) Prior Publication Data

US 2020/0101478 A1 Apr. 2, 2020

(30) Foreign Application Priority Data

Sep. 27, 2018 (JP) ..... 2018-182015

(51) Int. Cl.

| | |
|---|---|
| ***B05B 11/04*** | (2006.01) |
| ***B41J 2/16*** | (2006.01) |
| ***B41J 2/055*** | (2006.01) |
| ***B41J 2/14*** | (2006.01) |

(52) U.S. Cl.

CPC ..... *B05B 11/043* (2013.01); *B41J 2/055* (2013.01); *B41J 2/161* (2013.01); *B41J 2002/14241* (2013.01); *B41J 2002/14491* (2013.01)

(58) Field of Classification Search

CPC ..... B05B 11/043; B41J 2/161; B41J 2/055; B41J 2002/14491; B41J 2002/14241; B41J 2202/12; B41J 2/14233

USPC ..... 347/44

See application file for complete search history.

(56) References Cited

U.S. PATENT DOCUMENTS

2011/0128335 A1* 6/2011 von Essen ..... B41J 2/18 347/89

2018/0072066 A1 3/2018 Yoneta

FOREIGN PATENT DOCUMENTS

JP 2017-177752 A 10/2017

JP 2018-47683 A 3/2018

* cited by examiner

*Primary Examiner* — Huan H Tran

*Assistant Examiner* — Alexander D Shenderov

(74) *Attorney, Agent, or Firm* — Merchant & Gould P.C.

(57) ABSTRACT

A liquid discharge head includes: individual channels respectively including nozzles; a supply channel allowing an outlet of a storage chamber storing a liquid to communicate with an inlet of each of the individual channels; a return channel allowing an outlet of each of the individual channels to communicate with an inlet of the storage chamber; a return filter provided in the return channel; and a return branching channel branching off from a return upstream portion of the return channel. The return upstream portion is positioned upstream of the return filter.

17 Claims, 8 Drawing Sheets

LIQUID DISCHARGE HEAD AND LIQUID DISCHARGE APPARATUS

CROSS REFERENCE TO RELATED APPLICATION

The present application claims priority from Japanese Patent Application No. 2018-182015 filed on Sep. 27, 2018, the disclosure of which is incorporated herein by reference in its entirety.

BACKGROUND

Field of the Invention

The present disclosure relates to a liquid discharge head including a supply channel and a return channel as well as a liquid discharge apparatus provided with the liquid discharge head.

Description of the Related Art

There is known a liquid discharge head configured to circulate liquid between a tank (storage chamber) and individual liquid chambers (individual channels) via a supply-side common liquid chamber (supply channel) and a discharge-side common liquid chamber (return channel), wherein the discharge-side common liquid chamber includes a filter. The filter inhibits foreign matter from invading the individual liquid chambers (individual channels) through the discharge-side common liquid chamber (return channel) at the time of assembling the liquid discharge head.

SUMMARY

In the above configuration, however, bubbles may accumulate in an upstream portion of the filter during liquid circulation, which may cause clogging of the filter. The clogging of the filter may interfere with liquid circulation, which may cause a shortage of liquid supply to the individual channels. Further, the clogging of the filter may increase the channel resistance of the return channel, which may require great driving force of a pump for liquid circulation. Furthermore, the clogging of the filter may make the channel resistance at an upstream side from the nozzle different from the channel resistance at a downstream side from the nozzle, which may break a meniscus of the nozzle and liquid may leak from the nozzle.

An object of the present disclosure is to provide a liquid discharge head that is capable of inhibiting clogging of a filter provided in a return channel and a liquid discharge apparatus provided with the liquid discharge head.

According to a first aspect of the present disclosure, there is provided a liquid discharge head, including: a plurality of individual channels respectively including a plurality of nozzles; a supply channel allowing an outlet of a storage chamber storing a liquid to communicate with an inlet of each of the individual channels; a return channel allowing an outlet of each of the individual channels to communicate with an inlet of the storage chamber, a return filter provided in the return channel; and a return branching channel branching off from a return upstream portion of the return channel, the return upstream portion being positioned upstream of the return filter.

According to a second aspect of the present disclosure, there is provided a liquid discharge head, including: a plurality of individual channels respectively including a plurality of nozzles; a supply channel allowing an outlet of a storage chamber storing a liquid to communicate with an inlet of each of the individual channels; a return channel allowing an outlet of each of the individual channels to communicate with an inlet of the storage chamber; a return filter provided in the return channel; a return branching channel branching off from a return upstream portion of the return channel, the return upstream portion being positioned upstream in the return filter; a valve switchable between a first position and a second position, the valve in the first position not allowing the individual channels to communicate with the return branching channel and allowing the individual channels to communicate with the storage chamber via the return channel, the valve in the second position not allowing the individual channels to communicate with the storage chamber via the return channel and allowing the individual channels to communicate with the return branching channel; a pump; and a controller, wherein, in a bubble removal process, the controller is configured to execute a first process in which the liquid moves from the storage chamber to flow through the supply channel, each of the individual channels, the return upstream portion, and the return branching channel by driving the pump with the valve being in the second position.

DESCRIPTION OF THE EMBODIMENTS

<Printer 100>

Figure 1:
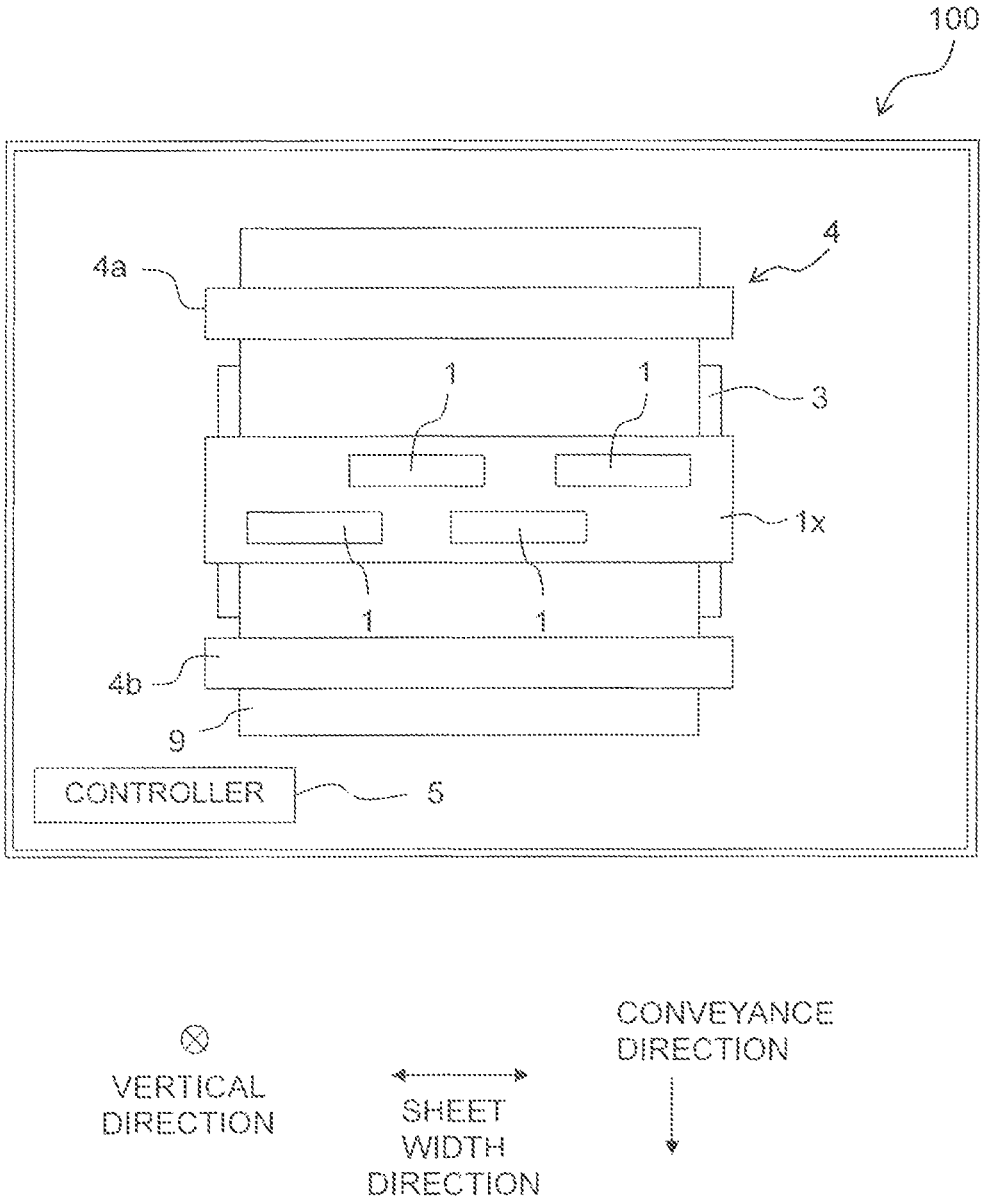
FIG. 1 is a plan view of heads and a printer according to an embodiment of the present disclosure.

Referring to FIG. 1, a configuration of a printer 100 according to an embodiment of the present disclosure is explained below. A conveyance direction, a vertical direction, and a sheet width direction of the embodiment of the present disclosure are defined as indicated in FIG. 1.

The printer 100 includes a head unit 1*x* including four heads 1, a platen 3, a conveyer 4, and a controller 5.

The conveyer 4 has two roller pairs 4*a* and 4*b* arranged in the conveyance direction (a direction orthogonal to the vertical direction) with the platen 3 interposed therebetween. Driving a conveyance motor 4*m* (see FIG. 7) rotates the roller pairs 4*a* and 4*b* nipping a sheet 9, thus conveying the sheet 9 in the conveyance direction.

The head unit 1*x* is a line-type head unit in which ink is discharged from nozzles 33*d* (see FIGS. 2 and 3) to the sheet 9 with the position of the head unit 1*x* being fixed. The head unit 1*x* is long in the sheet width direction (a direction orthogonal to the vertical direction and the conveyance direction). The four heads 1 are arranged zigzag in the sheet width direction.

The platen 3, which is a flat-plate member, is disposed below the head unit 1*x* in a position between the roller pairs 4*a* and 4*b* in the conveyance direction. The sheet 9 is placed on an upper surface of the platen 3.

The controller 5 includes a Read Only Memory (ROM), a Random Access Memory (RAM), and an Application Specific Integrated Circuit (ASIC). The ASIC executes a recording process and the like in accordance with programs stored in the ROM. In the recording process, the controller 5 controls the conveyance motor 4*m* and a driver IC 1*d* of each head 1 (see FIG. 7) based on a recording command (including image data) input from an external apparatus, such as a PC, to record an image on the sheet 9.

<Head 1>

Figure 3:
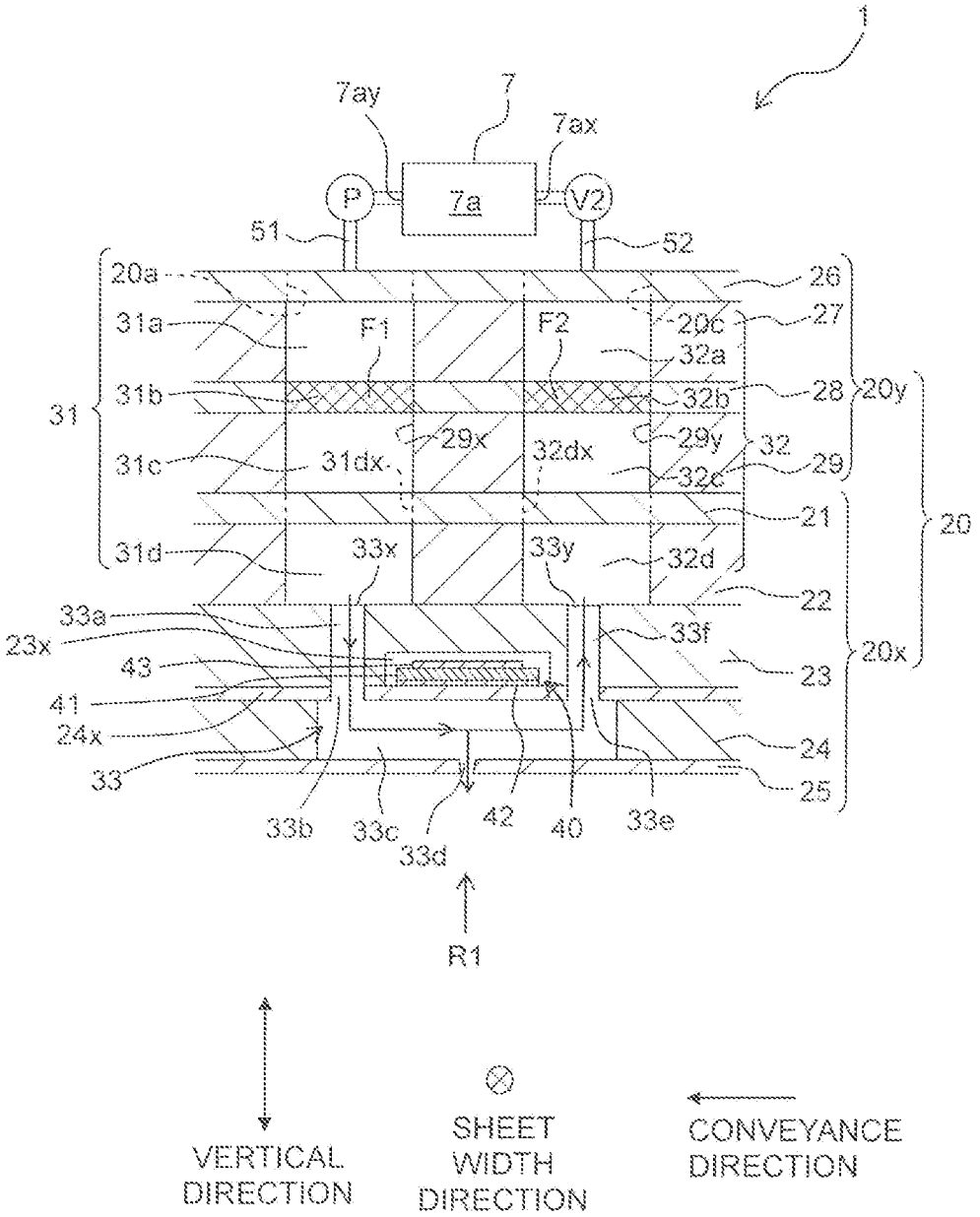
FIG. 3 is a cross-sectional view of the head taken along a line in FIG. 2.

As depicted in FIG. 3, the head 1 includes a channel unit 20*x* and a filter unit 20*y* disposed on the channel unit 20*x*. The channel unit 20*x* includes five plates 21 to 25 stacked on top of each other in the vertical direction. The plates 21 to 25 are joined to each other. The filter unit 20*y* includes four plates 26 to 29 stacked on top of each other in the vertical direction. The plates 26 to 29 are joined to each other.

Of the five plates 21 to 25 forming the channel unit 20*x*, the lowermost plate 25 has through holes forming the respective nozzles 33*d*.

Figure 2:
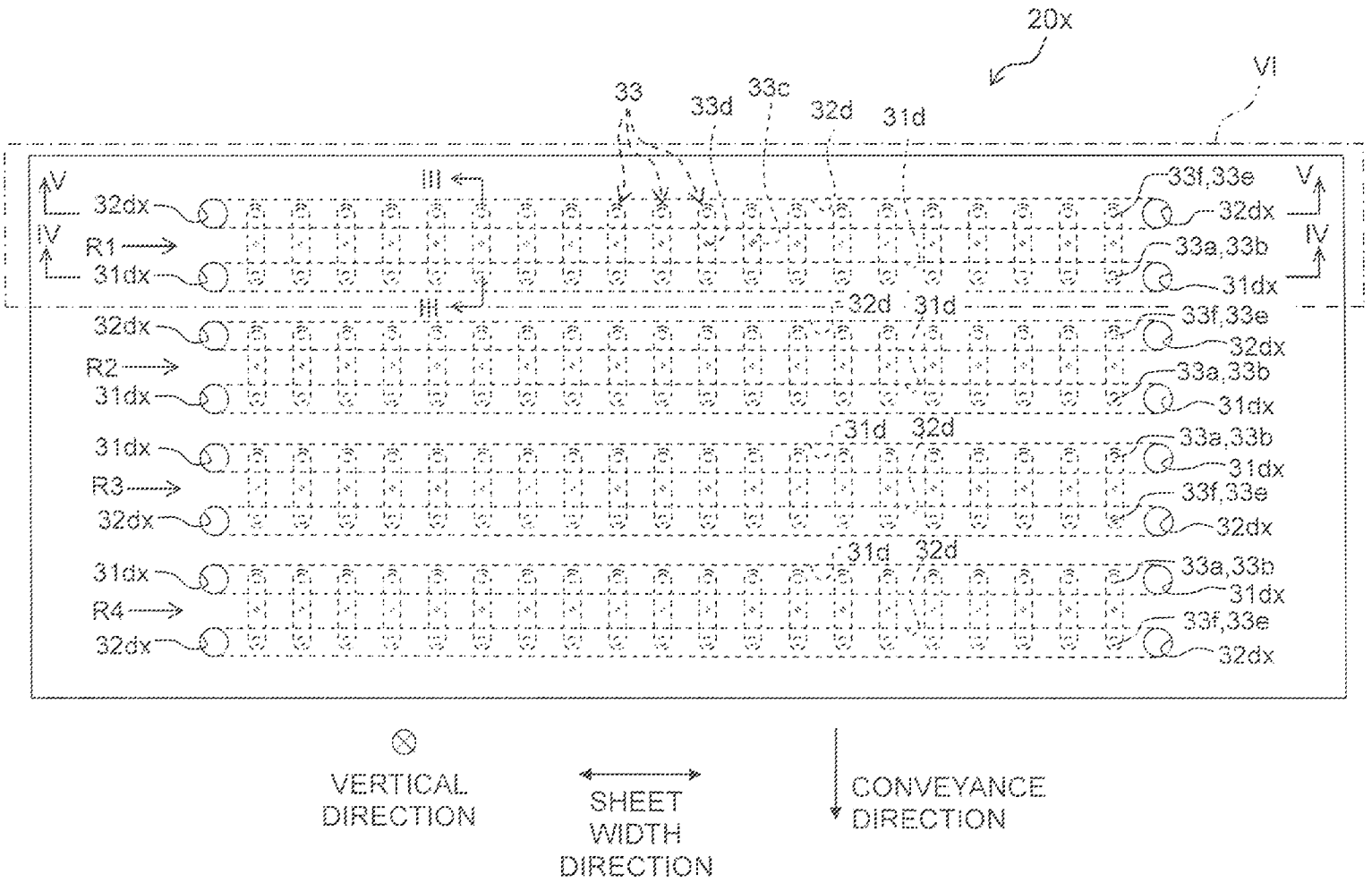
FIG. 2 is a plan view of a channel unit in the head.

The plate 24 is disposed on an upper surface of the plate 25. The plate 24 has through holes forming respective pressure chambers 33*c*. Each of the pressure chambers 33*c* is formed corresponding to one of the nozzles 33*d*. As depicted in FIG. 2, each of the nozzles 33*d* overlaps in the vertical direction with a center portion in the sheet width direction and the conveyance direction of the corresponding one of the pressure chambers 33*c*.

Multiple pairs each including one nozzle 33*d* and one pressure chamber 33*c* are arranged in the sheet width direction to form four rows R1 to R4. The four rows R1 to R4 are arranged in the conveyance direction. A black ink is discharged from the nozzles 33*d* belonging to the first row R1 from an upstream side in the conveyance direction. A yellow ink is discharged from the nozzles 33*d* belonging to the second row R2 from the upstream side in the conveyance direction. A cyan ink is discharged from the nozzles 33*d* belonging to the third row R3 from the upstream side in the conveyance direction. A magenta ink is discharged from the nozzles 33*d* belonging to the fourth row R4 from the upstream side in the conveyance direction.

As depicted in FIG. 3, a vibration film 24*x* is disposed on an upper surface of the plate 24. The vibration film 24*x* covers the pressure chambers 33*c*. The vibration film 24*x* has through holes forming inflow channels 33*b* at portions overlapping in the vertical direction with downstream ends in the conveyance direction of the pressure chambers 33*c* belonging to the rows R1 and R2 (see FIG. 2) and at portions overlapping in the vertical direction with upstream ends in the conveyance direction of the pressure chambers 33*c* belonging to the rows R3 and R4 (see FIG. 2). Further, the vibration film 24*x* has through holes forming outflow channels 33*e* at portions overlapping in the vertical direction with upstream ends in the conveyance direction of the pressure chambers 33*c* belonging to the rows R1 and R2 (see FIG. 2) and at portions overlapping in the vertical direction with downstream ends in the conveyance direction of the pressure chambers 33*c* belonging to the rows R3 and R4 (see FIG. 2). The vibration film 24*x* is made using, for example, silicon dioxide ($SiO_2$). In that case, the vibration film 24*x* is formed by oxidizing the upper surface of the plate 24.

The plate 23 is disposed on an upper surface of the vibration film 24*x*. As depicted in FIGS. 2 and 3, the plate 23 has through holes forming inflow channels 33*a* at portions overlapping in the vertical direction with the respective inflow channels 33*b*. Further, the plate 23 has through holes forming outflow channels 33*f* at portions overlapping in the vertical direction with the respective outflow channels 33*e*. As depicted in FIG. 3, a lower surface of the plate 23 includes four recesses 23*x* that accommodate four respective actuators 40. Each of the actuators 40 is disposed in a space formed by the vibration film 24*x* and the recess 23*x*.

The four actuators 40 are provided corresponding to the four respective rows R1 to R4. Each actuator 40 includes a common electrode 42 disposed on the upper surface of the vibration film 24*x*, a piezoelectric body 41 disposed on an upper surface of the common electrode 42, and individual electrodes 43 disposed on an upper surface of the piezoelectric body 41. The piezoelectric body 41 and the common electrode 42 extend in the sheet width direction over the pressure chambers 33*c* belonging to each of the rows R1 to R4. The individual electrodes 43 are provided corresponding to the respective pressure chambers 33*c* to overlap in the vertical direction the respective pressure chambers 33*c*.

Figure 7:
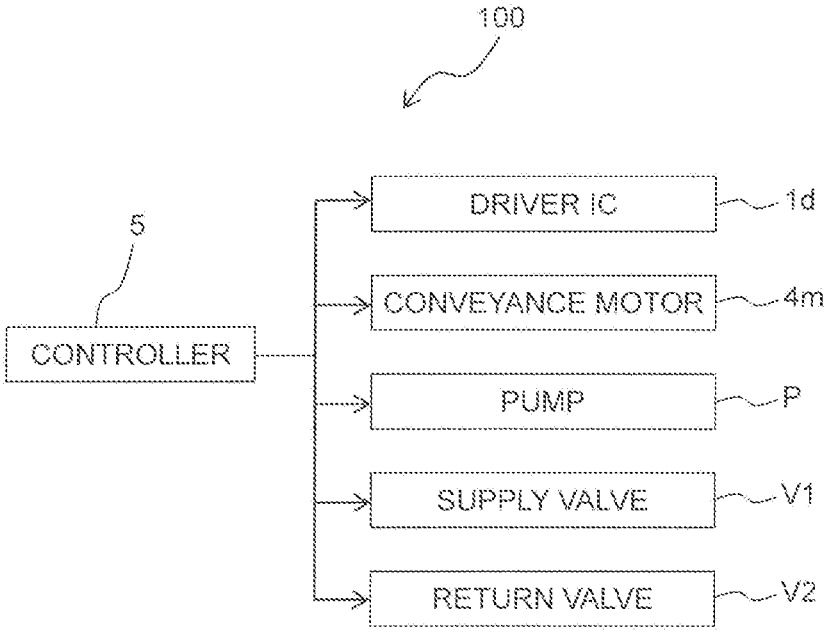
FIG. 7 is a block diagram of an electrical configuration of the printer.

The common electrode 42 and the individual electrodes 43 are electrically connected to the driver IC 1*d* (see FIG. 7). The controller 5 controls the driver IC 1*d* to keep the potential of the common electrode 42 the ground potential and to change the potential of each individual electrode 43. Specifically, the driver IC 1*d* generates a driving signal based on a control signal from the controller 5 and supplies the driving signal to the individual electrode 43. This changes the potential of the individual electrode 43 between a predefined driving electrode and the ground potential. The change in potential of the individual electrode 43 deforms a portion that is included in the vibration film 24*x* and the piezoelectric body 41 and is interposed between the individual electrode 43 and the pressure chamber 33*c* so that the portion becomes convex toward the pressure chamber 33*c*. This changes the volume of the pressure chamber 33*c* to apply pressure to ink in the pressure chamber 33*c*, thus discharging ink from the nozzle 33*d*.

The plates 23 to 25 and the vibration film 24*x* include individual channels 33 each of which is formed by the inflow channel 33*a*, the inflow channel 33*b*, the pressure chamber 33*c*, the nozzle 33*d*, and the outflow channel 33*e*, and the outflow channel 33*f*. An upper end of the inflow channel 33*a* corresponds to an inlet 33*x* of the individual channel 33, and an upper end of the outflow channel 33*f* corresponds to an outlet 33*y* of the individual channel 33.

The manifold plate 22 is disposed on an upper surface of the plate 23. The manifold plate 22 includes four supply common channels 31*d* and four return common channels 32*d*. As depicted in FIG. 2, a set or group of one supply common channel 31*d* and one return common channel 32*d* is provided for each of the four rows R1 to R4. The arrangement of the common channels 31*d* and 32*d* in the rows R1 and R2 is opposite to that in the rows R3 and R4. The return common channel 32*d* is disposed at the upstream side in the conveyance direction and the supply common channel 31*d* is disposed at the downstream side in the conveyance direction in each of the rows R1 and R2, and the supply common channel 31*d* is disposed at the upstream side in the conveyance direction and the return common channel 32*d* is disposed at the downstream side in the conveyance direction in each of the rows R3 and R4. The supply common channels 31*d* extend in the sheet width direction to overlap in the vertical direction with the inflow channels 33*a* that communicate with the pressure chambers 33*c* belonging to the rows R1 to R4. The return common channels 32*d* extend in the sheet width direction to overlap in the vertical direction with the outflow channels 33*f* that communicate with the pressure chambers 33*c* belonging to the rows R1 to R4.

Figure 4:
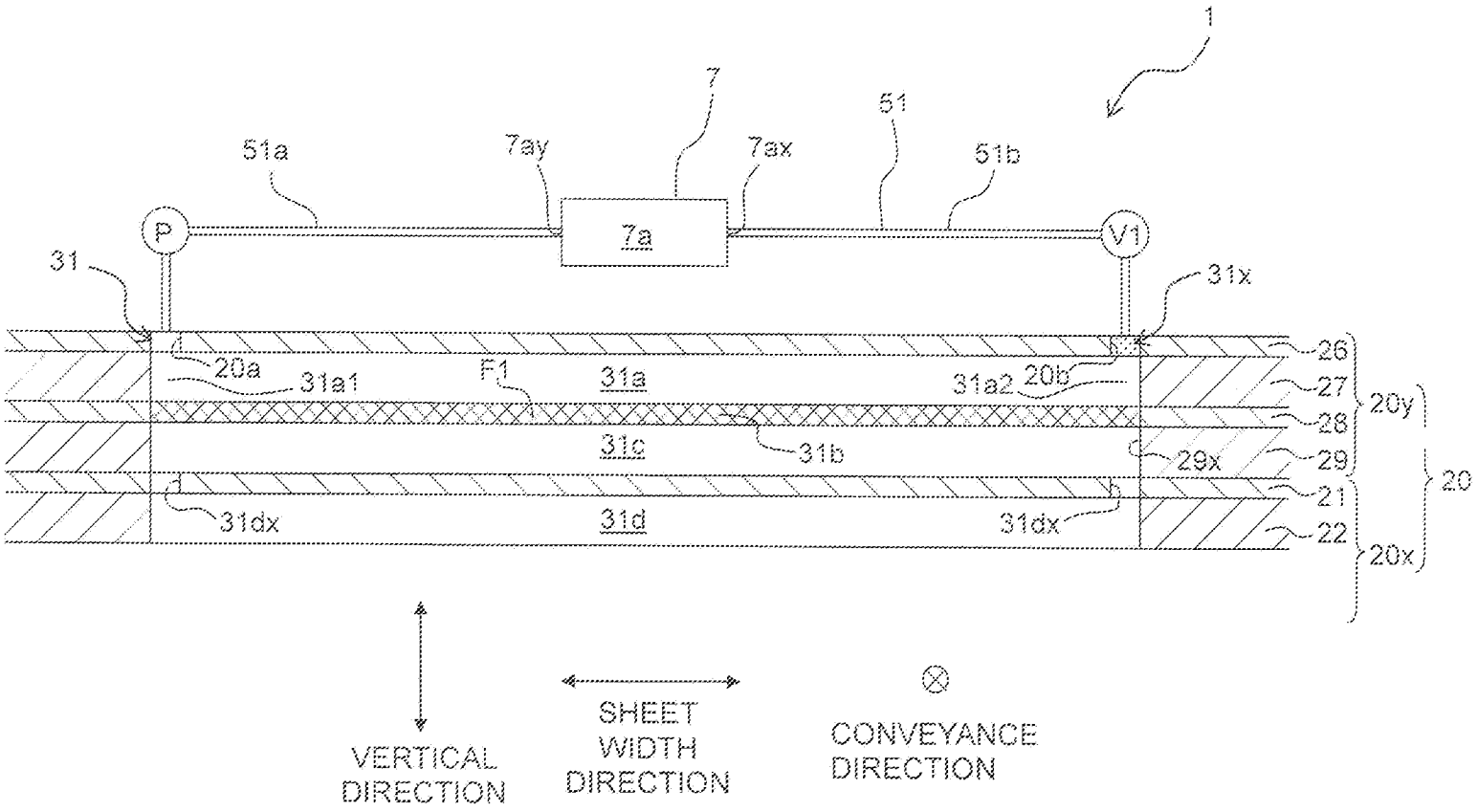
FIG. 4 is a cross-sectional view of a manifold plate and a portion positioned above the manifold plate in the head taken along a line IV-IV in FIG. 2.
Figure 5:
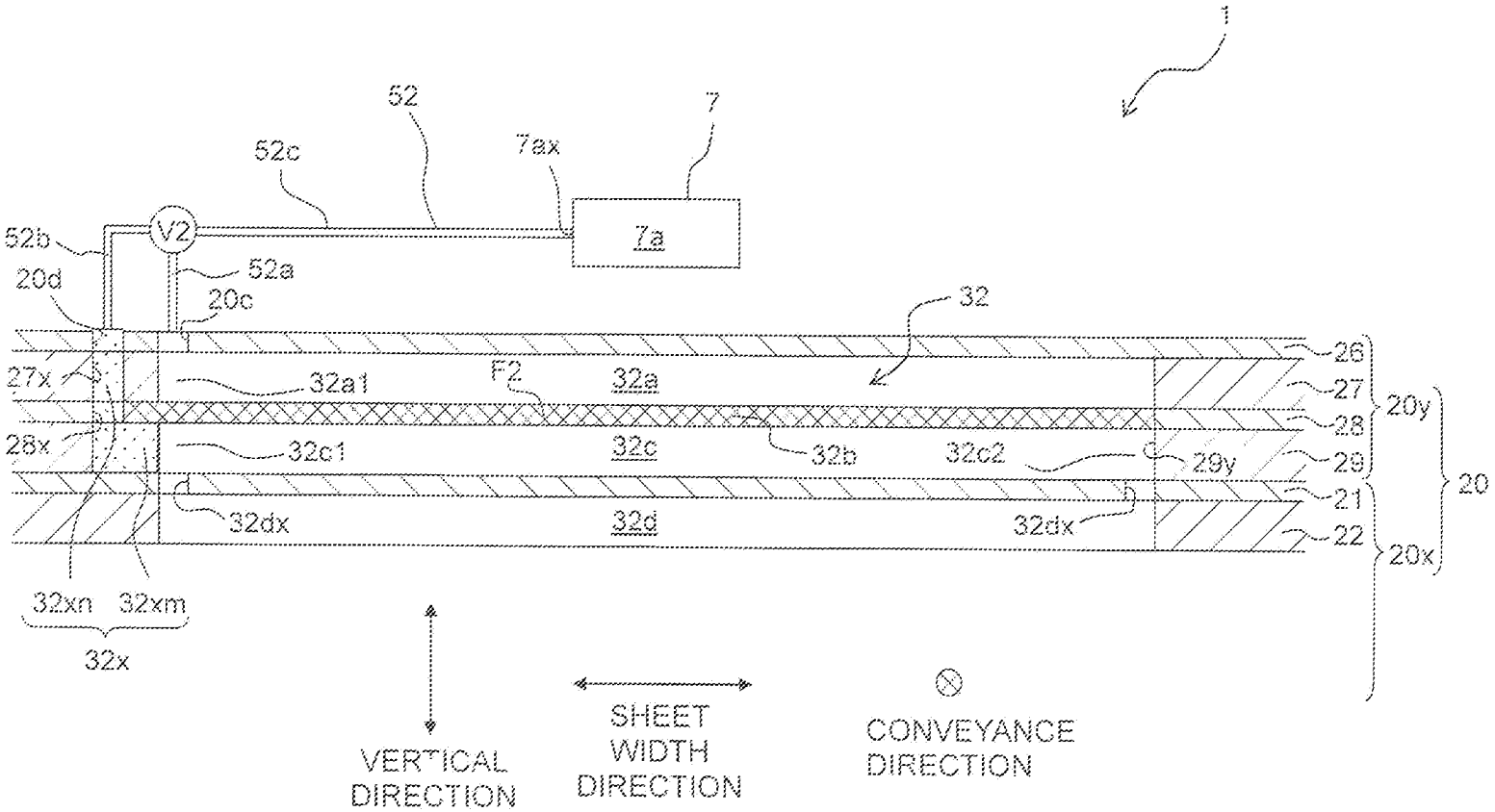
FIG. 5 is a cross-sectional view of the manifold plate and the portion positioned above the manifold plate in the head taken along a line V-V in FIG. 2.

As depicted in FIGS. 3 to 5, the plate 21 is disposed on an upper surface of the manifold plate 22. As depicted in FIGS. 2 and 4, the plate 21 has supply holes 31*dx* at portions overlapping in the vertical direction with ends in the sheet width direction of each supply common channel 31*d*. As depicted in FIGS. 2 and 5, the plate 21 has return holes 32*dx* at portions overlapping in the vertical direction with ends in the sheet width direction of each return common channel 32*d*.

Figures 6A, 6B, 6C, 6D:
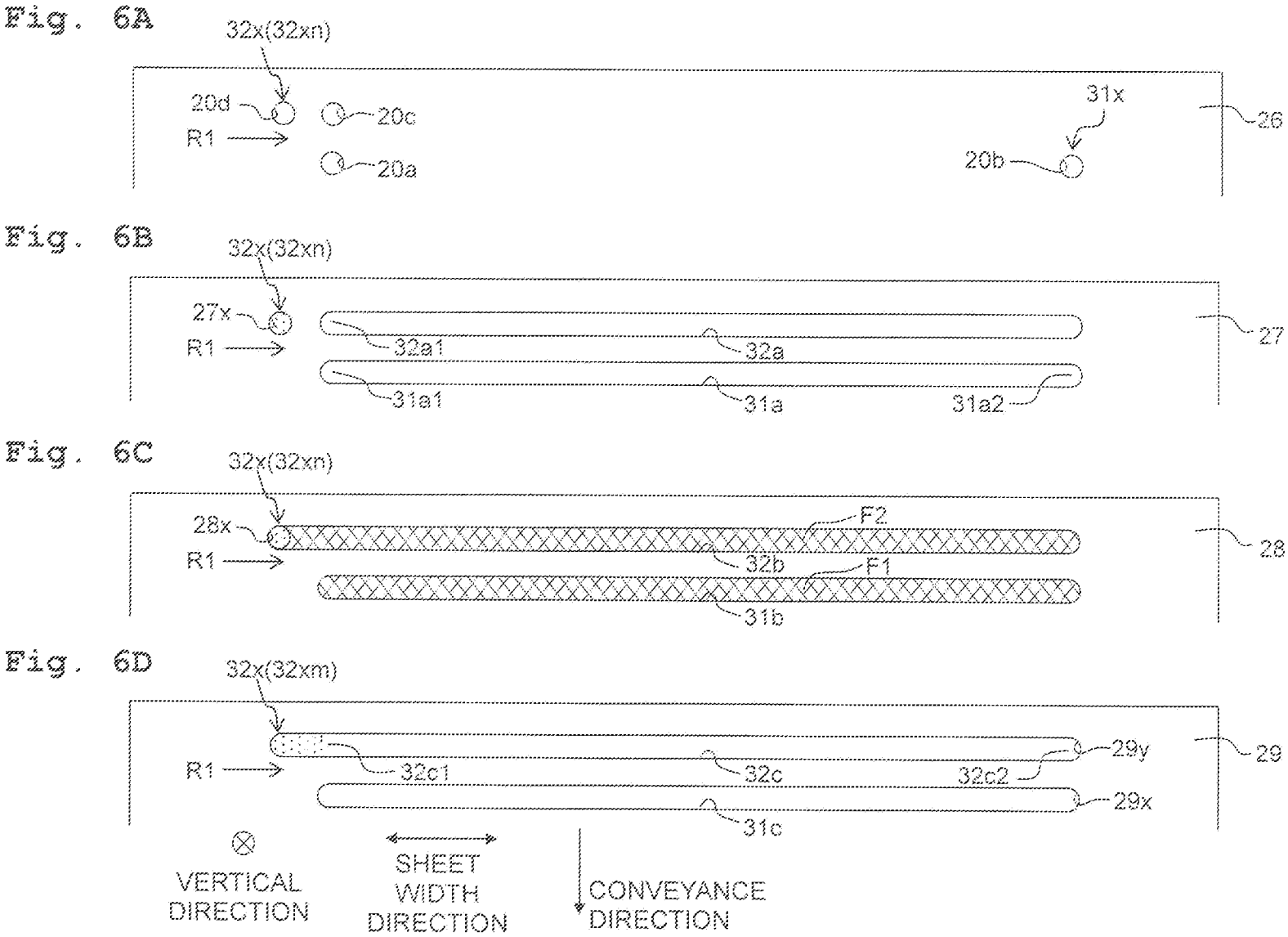
FIGS. 6A to 6D are plan views of plates forming a filter unit of the head in an area VI depicted in FIG. 2.

As depicted in FIGS. 3 to 5, of the four plates 26 to 29 forming the filter unit 20*y*, the lowermost plate 29 is disposed on an upper surface of the plate 21. The plate 29 includes four channels 31*c* overlapping in the vertical direction with the four respective supply common channels 31*d* and four channels 32*c* overlapping in the vertical direction with the four respective return common channels 32*d*. As depicted in FIG. 6D, one channel 31*c* and one channel 32*c* are arranged side by side in the conveyance direction. Each of the channels 31*c* and 32*c* extends in the sheet width direction.

In the plate 29, through holes 29*y* forming the channels 32*c* are longer in the sheet width direction than through holes 29*x* forming the channels 31*c*. Each through hole 29*y* forms not only the channel 32*c* but also an extending portion 32*xm* that extends in the sheet width direction from a first end 32*c*1 in the sheet width direction of the channel 32*c*. The length in the sheet width direction from the first end 32*c*1 in the sheet width direction of the channel 32*c* to a second end 32*c*2 is the same as the length in the sheet width direction of the channel 31*c*. The channels 31*c* and 32*c* overlap with each other in the conveyance direction.

The length (width) in the conveyance direction of the extending portion 32*xm* is equal to the width of the channel 32*c*. No irregularities are present between the channel 32*c* and the extending portion 32*xm* as viewed in the vertical direction. The width of the channel 31*c* is equal to the width of the channel 32*c*. Specifically, the width of each of the channel 31*c*, the channel 32*c*, and the extending portion 32*xm* is approximately 1.0 to 1.5 mm.

The plate 29 is provided with the channels 31*c*, the channels 32*c*, and the extending portions 32*xm*, and thus the channels 31*c*, the channels 32*c*, and the extending portions 32*xm* have the same length (depth) in the vertical direction. As depicted in FIG. 5, there is no height difference between the channel 32*c* and the extending portion 32*xm* as viewed in a direction orthogonal to the vertical direction (e.g., the sheet width direction and the conveyance direction). Specifically, the thickness of the plate 29 is approximately 0.3 to 0.7 mm, and the depth of each of the channels 31*c*, the channels 32*c*, and the extending portions 32*xm* is approximately 0.3 to 0.7 mm.

As depicted in FIGS. 3 to 5, a filter plate 28 is disposed on an upper surface of the plate 29. The filter plate 28 includes four channels 31*b* overlapping in the vertical direction with the four respective channels 31*c* and four channels 32*b* overlapping in the vertical direction with the four respective channels 32*c* and the four respective extending portions 32*xm*. Each channel 31*b* is provided with a supply filter F1. Part of each channel 32*b* except for an end in the sheet width direction is provided with a return filter F2.

Each of the filters F1 and F2 may be, for example, an electroformed filter that has fine or minute through holes over its entire area. The diameter of the through holes is approximately 10 μm. The electroformed filter can be made more accurately, for example, than a mesh filter made using stainless steel. The electroformed filter is finely made to have high filtering performance.

As depicted in FIG. 6C, the end in the sheet width direction of each channel 32*b* in the filter plate 28 is formed as a through hole 28*x* where the return filter F2 is not provided. The through hole 28*x* forms a protrusion 32*xm* protruding upward from an upper end surface of the extending portion 32*xm*.

As depicted in FIG. 5, the return filter F2 extends in the sheet width direction to overlap in the vertical direction with the extending portion 32*xm*. The upper end surface of the extending portion 32*xm* is in the same position as the return filter F2 in the vertical direction.

As depicted in FIGS. 3 to 5, the plate 27 is disposed on an upper surface of the filter plate 28. The plate 27 includes four channels 31*a* overlapping in the vertical direction with the four respective channels 31*b*, four channels 32*a* overlapping in the vertical direction with the four respective channels 32*c*, and four through holes 27*x* overlapping in the vertical direction with the four respective through holes 28*x*. As depicted in FIG. 6B, one channel 31*a* and one channel 32*a* are arranged side by side in the conveyance direction. The four channels 31*a* and the four channels 32*a* extend in the sheet width direction. As depicted in FIG. 5, one through hole 27*x* and one through hole 28*x* form one protrusion 32*xn*. The plate 27 defines part of the protrusion 32*xn* positioned above the return filter F2. Part of a lower surface of the plate 27 between the through hole 27*x* and the channel 32*a* (a portion overlapping in the vertical direction with the extending portion 32*xm*) is joined to the return filter F2.

As depicted in FIGS. 3 to 5, the plate 26 is disposed on an upper surface of the plate 27. As depicted in FIGS. 4 and 6A, the plate 26 has a through hole 20*a* at a portion overlapping in the vertical direction with a first end 31*a*1 in the sheet width direction of each channel 31*a* and a through hole 20*b* at a portion overlapping in the vertical direction with a second end 31*a*2 in the sheet width direction with each channel 31*a*. As depicted in FIGS. 5 and 6A, the plate 26 has a through hole 20*c* at a portion overlapping in the vertical direction with a first end 32*a*1 in the sheet width direction of each channel 32*a* and a through hole 20*d* at a portion overlapping in the vertical direction with each through hole 27*x*.

As depicted in FIG. 4, the through holes 20*a* and 20*b* communicate with a storage chamber 7*a* of a subtank 7 via a tube 51. The tube 51 is provided with a pump P and a supply valve V1. The tube 51 has a tube portion 51*a* connecting the through hole 20*a* and an outlet lay of the storage chamber 7*a* and a tube portion 51*b* connecting the through hole 20*b* and an inlet 7*ax* of the storage chamber 7*a*. The tube portion 51*a* is provided with the pump P, and the tube portion 51*b* is provided with the supply valve V1.

As depicted in FIG. 5, the through holes 20*c* and 20*d* communicate with the storage chamber 7*a* of the subtank 7 via a tube 52. The tube 52 is provided with a return valve V2. The tube 52 has a tube portion 52*a* connecting the through hole 20*c* and the return valve V2, a tube portion 52*b* connecting the through hole 20*d* and the return valve V2, and a tube portion 52*c* connecting the return valve V2 and the inlet 7*ax* of the storage chamber 7*a*.

The subtank 7 is provided for each of the rows R1 to R4. Different colors of inks are stored in the storage chambers 7*a* of the subtanks 7. Specifically, the subtank 7 having the storage chamber 7*a* for storing the black ink corresponds to the row R1; the subtank 7 having the storage chamber 7*a* for storing the yellow ink corresponds to the row R2; the subtank 7 having the storage chamber 7*a* for storing the cyan ink corresponds to the row R3; and the subtank 7 having the storage chamber 7*a* for storing the magenta ink corresponds to the row R4.

Four main tanks (not depicted) respectively containing the black ink, yellow ink, cyan ink, and magenta ink are installed in the printer 100. The subtank 7 provided for the row R1 communicates with the main tank for the black ink and contains the black ink supplied from the corresponding main tank. The subtank provided for the row R2 communicates with the main tank for the yellow ink and contains the yellow ink supplied from the corresponding main tank. The subtank provided for the row R3 communicates with the main tank for the cyan ink and contains the cyan ink supplied from the corresponding main tank. The subtank provided for the row R4 communicates with the main tank for the magenta ink and contains the magenta ink supplied from the corresponding main tank.

As depicted in FIGS. 3 and 4, the channel unit 20 includes the supply channel 31 for each of the four rows R1 to R4. The supply channel 31 communicates with the outlet lay of the storage chamber 7*a* and the inlet 33*x* of each individual channel 33. A supply branching channel 31*x* (a hatched channel in FIG. 4) branches off from the channel 31*a* of the supply channel 31. The channel 31*a* is an upstream portion of the supply filter F1. The supply channel 31 is formed by the channels 31*a* to 31*d*, the supply hole 31*dx*, and the through hole 20*a*. The supply branching channel 31*x* is formed by the through hole 20*b*.

As depicted in FIG. 4, the first end 31*a*1 in the sheet width direction of the channel 31*a* is connected to the outlet lay of the storage chamber 7*a* via the through hole 20*a* and the tube 51. The second end 31*a*2 in the sheet width direction of the channel 31*a* is connected to the through hole 20*b* (the supply branching channel 31*x*).

As depicted in FIGS. 3 and 5, the channel unit 20 includes a return channel 32 for each of the four rows R1 to R4. The return channel 32 communicates with the outlet 33*y* of each individual channel 33 and the inlet 7*ax* of the storage chamber 7*a*. A return branching channel 32*x* (a hatched channel in FIG. 5) branches off from the channel 32*c* of the return channel 32. The channel 32*c* is an upstream portion of the return filter F2. The return channel 32 is formed by the channels 32*a* to 32*d*, the return hole 32*dx*, and the through hole 20*c*. The return branching channel 32*x* includes the extending portion 32*xm* and the protrusion 32*xn*. The protrusion 32*xn* is formed by the through holes 20*d*, 27*x*, and 28*x*.

As depicted in FIG. 6A, the supply branching channel 31*x* is disposed in the vicinity of an end in the sheet width direction of the plate 26. Meanwhile, as depicted in FIGS. 6A to 6D, the return branching channel 32*x* is disposed in the vicinity of the other end in the sheet width direction of each of the plates 26 to 29. The first end 32*c*1 in the sheet width direction of the channel 32*c* (a connection portion with the return branching channel 32*x*) is farther away from the supply branching channel 31*x* than the second end 32*c*2 in the sheet width direction of the channel 32*c*.

<Circulation of Ink>

The controller 5 controls the pump P and the valves V1 and V2 (see FIGS. 3 to 5) to circulate ink between the subtank 7 and the channel unit 20.

The supply valve V1 is switchable or movable between an open position where ink is allowed to flow through the tube portion 51*b* (i.e., the channel of the tube portion 51*b* is open) and a closed position where ink is not allowed to flow through the tube portion 51*b* (i.e., the channel of the tube portion 51*b* is closed). When the supply valve V1 is in the open position, the storage chamber 7*a* communicates with the individual channels 33 via the supply branching channel 31*x*.

The return valve V2 is switchable or movable between a first position where the tube portion 52*a* communicates with the tube portion 52*c*, a second position where the tube portion 52*b* communicates with the tube portion 52*c*, and a third position where the tube portions 52*a* and 52*b* do not communicate with the tube portion 51*c* (i.e., the channel of the tube 52 is closed). The return valve V2 is, for example, a two-way solenoid valve (electromagnetic valve) that is electromagnetically switchable or movable between the above three positions. When the return valve V2 is in the first position, the storage chamber 7*a* communicates with the individual channels 33 via the return channel 32 and does not communicate with the individual channels 33 via the return branching channel 32*x*. When the return valve V2 is in the second position, the storage chamber 7*a* communicates with the individual channels 33 via the return branching channel 32*x* and does not communicate with the individual channels 33 via the return channel 32. When the return valve V2 is in the third position, the storage chamber 7*a* does not communicate with the individual channels 33 via the return channel 32 and does not communicate with the individual channels 33 via the return branching channel 32*x*.

In the recording process or the like, the controller 5 drives the pump P with the supply valve V1 being in the closed position and the return valve V2 being in the first position so that ink circulates through a circulation route. Namely, ink outflowing through the outlet lay of the storage chamber 7*a* flows through the supply channel 31, each individual channel 33, and the return channel 32, and then returns to the inlet lax of the storage chamber 7*a*. As depicted in FIG. 4, ink outflowing from the storage chamber 7*a* flows through the tube portion 51*a*, flows into the channel 31*a* through the through hole 20*a*, and passes through the supply filter F1. Ink passing through the supply filter F1 flows through the channel 31*c* and flows into the supply common channel 31*d* through the supply hole 31*dx*. As indicated by arrows in FIG. 3, ink flowing into the supply common channel 31*d* flows through the inlet 33*x* of each individual channel 33, flows through the inflow channels 33*a* and 33*b*, and flows into the pressure chamber 33*c*. Part of the ink flowing into the pressure chamber 33*c* is discharged from the nozzle 33*d* and remaining part of the ink flows through the outflow channels 33*e* and 33*f* and outflows through the outlet 33*y*. Ink outflowing from each individual channel 33 flows into the return common channel 32*d*. As depicted in FIG. 5, ink flowing into the return common channel 32*d* flows therethrough and flows into the channel 32*c* through the return hole 32*dx*. Ink flowing into the channel 32*c* passes through the return filter F2 and flows into the channel 32*a*. Ink flowing into the channel 32*a* outflows through the through hole 20*c*, flows through the tube portions 52*a* and 52*c*, and returns to the storage chamber 7*a*. Circulating ink as described above discharges bubbles in each individual channel 33 and inhibits ink from thickening. When ink contains a settling component (a component that may settle, such as pigment), the component is agitated or stirred to inhibit the settling.

Figure 8:
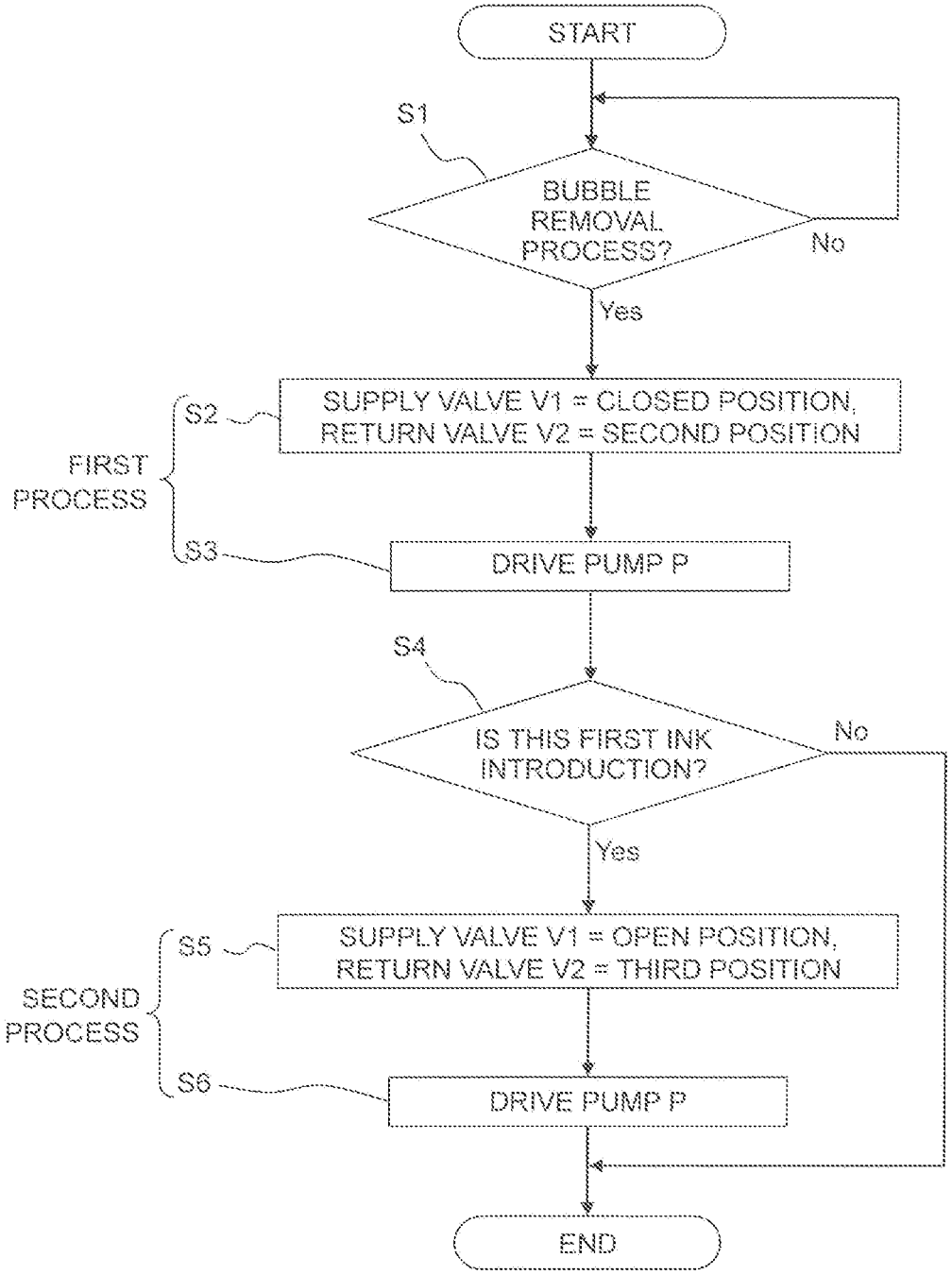
FIG. 8 is a flowchart indicating maintenance of the head executed by a controller of the printer.

The controller 5 circulates ink along a route including the return branching channel 32*x* to remove bubbles accumulated in a lower portion of the return filter F2 at the time of the maintenance of the head 1. Further, if necessary, the controller 5 circulates ink along a route including the supply branching channel 31*x* to remove bubbles accumulated in an upper portion of the supply filter F1. Referring to FIG. 8, the maintenance of the head 1 executed by the controller 5 is explained below.

The controller 5 first determines whether to execute a bubble removal process (S1). For example, the controller 5 determines to execute the bubble removal process when the controller 5 receives an input for executing the maintenance from a user or when ink is to be introduced from the main tank to the subtank 7 for the first time. For example, when ink is circulated along the circulation route in the recording process, the controller 5 determines that the bubble removal process is executed before the recording process. This inhibits a situation in which bubbles accumulated in the vicinities of the filters F1 and F2 interfere with the circulation of ink, affecting ink discharge for recording. When the controller 5 has determined not to execute the bubble removal process (S1: NO), the controller 5 repeats the step S1.

When the controller 5 has determined to execute the bubble removal process (S1: YES), the controller 5 controls the supply valve V1 to have the closed position and controls the return valve V2 to have the second position (S2). Then, the controller 5 drives the pump P (S3). This moves ink from the storage chamber 7*a* to flow through the supply channel 31, each individual channel 33, the channel 32*c*, and the return branching channel 32*x* (a first process). As depicted in FIG. 4, ink in the storage chamber 7*a* outflows through the outlet lay, flows through the tube portion 51*a*, flows into the channel 31*a* through the through hole 20*a*, and passes through the supply filter F1. Ink passing through the supply filter F1 flows through the channel 31*c* and flows into the supply common channel 31*d* through the supply hole 31*dx*. Ink flowing into the supply common channel 31*d* flows through each individual channel 33 as indicated by arrows in FIG. 3, and then, as depicted in FIG. 5, flows through the return common channel 32*d* and flows into the channel 32*c* through the return hole 32*dx*. Ink flowing into the channel 32*c* flows therethrough along a lower surface of the return filter F2, flows through the return branching channel 32*x* to outflow through the through hole 20*d*, flows through the tube portions 52*b* and 52*c*, and returns to the storage chamber 7*a*.

After the step S3, the controller 5 determines whether ink is to be introduced from the main tank to the subtank 7 for the first time (S4). When the controller has determined that ink was previously introduced from the main tank to the subtank 7 (S4: NO), the controller 5 ends this process.

When the controller 5 has determined that ink is to be introduced from the main tank to the subtank 7 for the first time (S4: YES), the controller 5 controls the supply valve V1 to have the open position and controls the return valve V2 to have the third position (S5). Then, the controller 5 drives the pump P (S6). This moves ink from the storage chamber 7*a* to flow through the channel 31*a* and the supply branching channel 31*x* (a second process). As depicted in FIG. 4, ink in the storage chamber 7*a* outflows through the outlet lay, flows through the tube portion 51*a*, and flows into the channel 31*a* through the through hole 20*a*. Ink flowing into the channel 31*a* flows therethrough along an upper surface of the supply filter F1, flows through the supply branching channel 31*x* to outflow through the through hole 20*b*, flows through the tube portion 51*b*, and returns to the storage chamber 7*a*.

After the step S6, the controller 5 ends this process.

In a case where ink flows the circulation route including the return channel 32 and not including the return branching channel 32*x*, the ink passes through the return filter F2. Whereas, in a case where ink flows the circulation route including the return branching channel 32*x*, with the ink does not pass through the return filter F2. If those circulation routes have difference levels of channel resistance, the menisci of the nozzles 33*d* would be broken and ink leakage would be caused. In order to inhibit the above problem, for example, the diameter of the protrusion 32*xn* is adjusted in this embodiment. This makes the channel resistance of the return branching channel 32*x* larger than the channel resistance of a downstream portion (the channel 32*a* and the through hole 20*c*) of the return filter F2 in the return channel 32 and makes the channel resistance of the return branching channel 32*x* equal to the channel resistance of the return filter F2.

In the above embodiment, the printer 100 corresponds to a liquid discharge apparatus of the present disclosure; the head 1 corresponds to a liquid discharge head of the present disclosure; the channel 31*a* corresponds to a supply upstream portion of the present disclosure; the channel 32*c* corresponds to a return upstream portion of the present disclosure; the return hole 32*dx* corresponds to a communicating portion of the present disclosure; the plate 27 corresponds to a protrusion defining member of the present disclosure; the return valve V2 corresponds to a valve of the present disclosure; the sheet width direction corresponds to a first direction of the present disclosure; the conveyance direction corresponds to a second direction of the present disclosure; and the vertical direction corresponds to a third direction of the present disclosure.

Effects of Embodiment

The head 1 of this embodiment includes the individual channels 33, the supply channel 31, the return channel 32, and the return branching channel 32*x* branching off from the upper portion (channel 32*c*) of the return filter F2 in the return channel 32 (see FIG. 5). In the bubble removal process, the controller 5 of the printer 100 drives the pump P with the return valve V2 being in the second position (steps S2 and S3 in FIG. 8) to execute the first process in which ink moves from the storage chamber 7*a* to flow through the supply channel 31, each individual channel 33, the channel 32*c*, and the return branching channel 32*x*. This discharges bubbles in the channel 32*c* through the return branching channel 32*x*, inhibiting the return filter F2 from being clogged.

In the head 1, the supply filter F1 is provided in the supply channel 31 (see FIG. 4). The supply filter F1 inhibits foreign matter (including dust, bubbles, and the like) from invading each individual channel 33 during the circulation of ink.

The head 1 includes the supply branching channel 31*x* branching off from the upstream portion (channel 31*a*) of the supply filter F1 in the supply channel 31 (see FIG. 4). In the bubble removal process, the controller 5 of the printer 100 drives the pump P with the supply valve V1 being in the open position and the return valve V2 being in the third position (steps S5 and S6 in FIG. 8) to execute not only the first process but also the second process in which ink moves from the storage chamber 7*a* to flow through the channel 31*a* and the supply branching channel 31*x*. This discharges bubbles in the channel 31*a* through the supply branching channel 31*x*, inhibiting the supply filter F1 from being clogged.

The first end 31*a*1 in the sheet width direction of the channel 31*a* is connected to the outlet lay of the storage chamber 7*a*, and the second end 31*a*2 in the sheet width direction of the channel 31*a* is connected to the supply branching channel 31*x* (see FIG. 4). In that configuration, ink flows through the channel 31*a* from the first end 31*a*1 toward the second end 31*a*2 in the sheet width direction. Since the supply branching channel 31*x* is connected to the second end 31*a*2, bubbles accumulated in the second end 31*a*2 are efficiently discharged from the supply branching channel 31*x*.

The first end 32*c*1 in the sheet width direction of the channel 32*c* (the connection portion with the return branching channel 32*x*) is farther away from the supply branching channel 31*x* than the second end 32*c*2 in the sheet width direction of the channel 32*c* (see FIGS. 6A to 6D). Arranging the return branching channel 32*x* in a position relatively far from the supply branching channel 31*x* results in a space where the branching channels 31*x* and 32*x* are provided.

The return hole 32*dx* that is the communicating portion with the outlet 33*y* of each individual channel 33 is provided (see FIG. 5) in an area ranging from the second end 32*c*2 in the sheet width direction to a center portion in the sheet width direction of the channel 32*c* (in this embodiment, in the second end 32*c*2 as depicted in FIG. 5). In that configuration, ink flows through the channel 32*c* from the second end 32*c*2 toward the first end 32*c*1 in the sheet width direction. Since the return branching channel 32*x* is connected to the first end 32*c*1, bubbles accumulated in the first end 32*c*1 are efficiently discharged from the return branching channel 32*x*.

The length in the conveyance direction of the extending portion 32*xm* is equal to the length in the conveyance direction of the channel 32*c* (see FIG. 6D), and the length in the vertical direction of the extending portion 32*xm* is equal to the length in the vertical direction of the channel 32*c* (see FIG. 5). In that configuration, the channel width and the channel height do not change in the connection portion where the channel 32*c* is connected to the return branching channel 32*x*, which creates no irregularities and no height difference. This inhibits bubbles from staying in the connection portion, and bubbles smoothly flow from the channel 32*c* to the return branching channel 32*x*. The discharge performance of bubbles accumulated in the channel 32*c* is thus improved.

The upper end surface of the extending portion 32*xm* is in the same position as the return filter F2 in the vertical direction (see FIG. 5). In that configuration, bubbles smoothly flow along the lower surface of the return filter F2 from the channel 32*c* to the extending portion 32*xm*. This further improves the discharge performance of bubbles accumulated in the channel 32*c*.

The return filter F2 extends in the sheet width direction to partially overlap in the vertical direction with the extending portion 32*xm*. Part of the plate 27 overlapping in the vertical direction with the extending portion 32*xm* is joined to the return filter F2 (see FIG. 5). The part of the plate 27 overlapping in the vertical direction with the extending portion 32*xm* has, on its lower side, a channel space for the extending portion 32*xm*, making it difficult to receive pressing force for the joining. If the part of the plate 27 overlapping in the vertical direction with the extending portion 32*xm* is joined to a member with no holes, joining force would be insufficient. In order to solve the problem, the configuration of this embodiment retains adhesive in the holes of the return filter F2, thus obtaining sufficient joining force.

The filter plate 28 provided with the return filter F2 has the through hole 28*x* forming the protrusion 32*xm* (see FIG. 5). That configuration can relatively easily satisfy the condition in which the length in the vertical direction of the extending portion 32*xm* is equal to the length in the vertical direction of the channel 32*c* and the condition in which the upper end surface of the extending portion 32*xm* is in the same position as the return filter F2 in the vertical direction.

The channel resistance of the return branching channel 32*x* is larger than the channel resistance of the downstream portion (the channel 32*a* and through hole 20*c*) of the return filter F2 in the return channel 32. The channel resistance of the downstream portion of the return filter F2 in the return channel 32 is typically smaller than the channel resistance of the return filter F2. Since the channel resistance of the return branching channel 32*x* is larger than the channel resistance of the downstream portion of the return filter F2 in the return channel 32, the channel resistance of the return branching channel 32*x* is close to the channel resistance of the return filter F2. This inhibits the difference in channel resistance between the circulation route including the return channel 32 and not including the return branching channel 32*x* and the circulation route including the return branching channel 32*x*. Ink leakage is thus inhibited.

The channel resistance of the return branching channel 32*x* is equal to the channel resistance of the return filter F2. That configuration reliably inhibits the difference in channel resistance between the circulation route including the return channel 32 and not including the return branching channel 32*x* and the circulation route including the return branching channel 32*x*. Ink leakage is thus reliably inhibited.

The head 1 includes the return valve V2 (see FIG. 5) that is switchable or movable between the first position and the second position. When the return valve V2 is in the first position, the storage chamber 7*a* does not communicate with the individual channels 33 via the return branching channel 32*x* and communicates with the individual channels 33 via the return channel 32. When the return valve V2 is in the second position, the storage chamber 7*a* does not communicate with the individual channels 33 via the return channel 32 and communicates with the individual channels 33 via the return branching channel 32*x*. This configuration can discharge bubbles in the channel 32*c* by switching or moving the return valve V2 from the first position to the second position (step S2 in FIG. 8) as needed.

The return valve V2 can be switched or moved to the third position where the storage chamber 7*a* does not communicate with the individual channels 33 via the return branching channel 32*x* and does not communicate with the individual channels 33 via the return channel 32. This configuration can circulate ink on the supply channel 31 side by positioning the return valve V2 in the third position (S5 in FIG. 8) as needed.

MODIFIED EXAMPLES

The embodiment of the present disclosure is explained above. The present disclosure, however, is not limited to the above. Various changes or modifications in the design may be made without departing from the claims.

The return branching channel and the supply branching channel may communicate with another storage chamber different from the storage chamber that communicates with the supply channel and the return channel or may be open to the atmosphere without being limited to the configuration in which the return branching channel and the supply branching channel communicate with the storage chamber that communicates with the supply channel and the return channel.

The return branching channel may be provided in a position close to the supply branching channel instead of being provided in the position away from the supply branching channel.

The supply branching channel and the supply filter may be omitted.

Irregularities and a height difference may be present between the extending portion and the end of the return upstream portion by making the length in the second direction (the conveyance direction in the above embodiment) of the extending portion of the return branching channel different from the length in the second direction of the end of the return upstream portion, or making the length in the third direction (the vertical direction in the above embodiment) of the extending portion of the return branching channel different from the length in the third direction of the end of the return upstream portion.

The size and pattern of the hole in the area of the return filter to be joined to the protrusion defining member (in the above embodiment, the area of the return filter F2 to be joined to the plate 27, see FIG. 5) may be different from the size(s) and pattern(s) of holes in any other areas (areas through which liquid flows) than the above area. For example, the area of the return filter to be joined to the protrusion defining member is not a portion for catching foreign matter, and thus the size of the hole in that area may be larger than those in any other areas (areas through which liquid flows). This allows the hole in the area of the return filter to be joined to the protrusion defining member to retain adhesive easily.

The return filter may not be joined to the protrusion defining member. For example, the return filter may not extend to the position overlapping in the vertical direction with the extending portion, and part of the protrusion defining member overlapping in the vertical direction with the extending portion may be exposed to the extending portion without being joined to the return filter.

The upper end surface of the extending portion of the return branching channel may be at a position different in the vertical direction from the return filter (e.g., a position above the return filter).

The through hole forming the protrusion of the return branching channel may be formed in any other member than the filter plate provided with the return filter.

The return branching channel is not limited to the configuration having the extending portion and the protrusion. For example, the return branching channel may be formed only having the extending portion (a portion extending in the first direction) or formed only having the protrusion (a portion extending upward).

The channel resistance of the return branching channel may not be equal to the channel resistance of the return filter. Or, the channel resistance of the return branching channel may be equal to or less than the channel resistance of the downstream portion of the return filter in the return channel.

The pump may be provided between the supply channel and the outlet of the storage chamber or between the return channel and the inlet of the storage chamber. Multiple pumps may be provided between the supply channel and the outlet of the storage chamber and between the return channel and the inlet of the storage chamber.

The number of supply common channels and the number of return common channels are not limited to the above. One supply common channel and one return common channel may be provided. Further, the position and the number of the supply holes and the position and the number of the return holes are not limited to the above.

The number of nozzles and the number of pressure chambers included in each individual channel are not limited to the above. For example, each individual channel may include one nozzle and two pressure chambers. Each individual channel may include two or more nozzles.

The actuator is not limited to a piezo-type actuator using piezoelectric elements. The actuator may be an actuator in any other type (e.g., a thermal-type actuator using heat generating elements and an electrostatic-type actuator using electrostatic force).

The head is not limited to the line-type head. The head may be a serial-type head in which liquid is discharged from nozzles onto a medium (an object to which liquid is to be discharged) during movement of the head in a scanning direction parallel to the sheet width direction.

The medium is not limited to the sheet or paper, and may be a cloth, a substrate, and the like.

The liquid discharged from the nozzles is not limited to the ink, and may be any liquid (e.g., a treatment liquid that agglutinates or precipitates constituents of ink, liquefied metal, and liquefied resin).

The present disclosure is applicable to facsimiles, copy machines, multifunction peripherals, and the like without limited to printers. The present disclosure is also applicable to a liquid discharge apparatus used for any other application than the image recording (e.g., a liquid discharge apparatus that forms an electroconductive pattern by discharging an electroconductive liquid on a substrate).

What is claimed is:

1. A liquid discharge head, comprising:

a plurality of individual channels respectively including a plurality of nozzles;

a supply channel allowing an outlet of a storage chamber storing a liquid to communicate with an inlet of each of the individual channels;

a return channel allowing an outlet of each of the individual channels to communicate with an inlet of the storage chamber;

a return filter provided in the return channel; and a return branching channel branching off from a return upstream portion of the return channel to communicate between the return upstream portion and the inlet of the storage chamber, the return upstream portion being positioned upstream of the return filter.

2. The liquid discharge head according to claim 1, further comprising a supply filter provided in the supply channel.

3. The liquid discharge head according to claim 2, further comprising a supply branching channel branching off from a supply upstream portion of the supply channel, the supply upstream portion being positioned upstream of the supply filter.

4. The liquid discharge head according to claim 3, wherein the supply upstream portion extends in a first direction, a first end in the first direction of the supply upstream portion is connected to the outlet of the storage chamber, and a second end in the first direction of the supply upstream portion is connected to the supply branching channel.

5. The liquid discharge head according to claim 4, wherein the return upstream portion extends in the first direction, the return upstream portion and the supply upstream portion are arranged side by side in a second direction orthogonal to the first direction, a first end in the first direction of the return upstream portion is farther away from the supply branching channel than a second end in the first direction of the return upstream portion, and the first end in the first direction of the return upstream portion is connected to the return branching channel.

6. The liquid discharge head according to claim 5, wherein a communicating portion communicating with the outlet of each of the individual channels is provided in an area ranging from the second end in the first direction of the return upstream portion to a center portion in the first direction of the return upstream portion.

7. The liquid discharge head according to claim 5, wherein the return branching channel includes an extending portion extending in the first direction from the first end in the first direction of the return upstream portion, a length in the second direction of the extending portion is equal to a length in the second direction of the first end of the return upstream portion, and a length in a third direction, which is orthogonal to the first direction and the second direction, of the extending portion is equal to a length in the third direction of the first end of the return upstream portion.

8. The liquid discharge head according to claim 7, wherein the third direction is a vertical direction, the return branching channel includes the extending portion and a protrusion protruding upward from an upper end surface of the extending portion, and a position in the vertical direction of the upper end surface of the extending portion is identical to a position in the vertical direction of the return filter.

9. The liquid discharge head according to claim 8, wherein the return filter extends in the first direction to partially overlap in the vertical direction with the extending portion, and a protrusion defining member defining a part of the protrusion positioned above the return filter is joined to the return filter at a portion overlapping in the vertical direction with the extending portion.

10. The liquid discharge head according to claim 9, further comprising a filter plate having the return filter and joined to the protrusion defining member, wherein the filter plate has a through hole forming the protrusion.

11. The liquid discharge head according to claim 1, wherein a channel resistance of the return branching channel is larger than a channel resistance of a downstream portion of the return filter in the return channel.

12. The liquid discharge head according to claim 11, wherein the channel resistance of the return branching channel is equal to a channel resistance of the return filter.

13. The liquid discharge head according to claim 1, further comprising a valve switchable between a first position and second position, wherein the valve in the first position allows the individual channels to communicate with the storage chamber via the return channel and does not allow the individual channels to communicate with the storage chamber via the return branching channel, and the valve in the second position allows the individual channels to communicate with the storage chamber via the return branching channel and does not allow the individual channels to communicate with the storage chamber via the return channel.

14. The liquid discharge head according to claim 13, wherein the valve is switchable to a third position, the valve in the third position does not allow the individual channels to communicate with the storage chamber via the return branching channel and does not allow the individual channels to communicate with the storage chamber via the return channel.

15. The liquid discharge head according to claim 1, wherein the return branching channel does not include the return filter.

16. A liquid discharge head, comprising:

a plurality of individual channels respectively including a plurality of nozzles;

a supply channel allowing an outlet of a storage chamber storing liquid to communicate with an inlet of each of the individual channels;

a return channel allowing an outlet of each of the individual channels to communicate with an inlet of the storage chamber;

a return filter provided in the return channel;

a return branching channel branching off from a return upstream portion of the return channel, the return upstream portion being positioned upstream of the return filter;

a valve switchable between a first position and a second position, the valve in the first position not allowing the individual channels to communicate with the return branching channel and allowing the individual channels to communicate with the storage chamber via the return channel, the valve in the second position not allowing the individual channels to communicate with the storage chamber via the return channel and allowing the individual channels to communicate with the return branching channel;

a pump; and a controller, wherein, in a bubble removal process, the controller is configured to execute a first process in which the liquid moves from the storage chamber to flow through the supply channel, each of the individual channels, the return upstream portion, and the return branching channel by driving the pump with the valve being in the second position.

17. The liquid discharge head according to claim 16, further comprising:

a supply filter provided in the supply channel, and a supply branching channel branching off from a supply upstream portion of the supply channel, the supply upstream portion being positioned upstream of the supply filter, wherein the valve is switchable to a third position, the valve in the third position does not allow the individual channels to communicate with the return branching channel and does not allow the individual channels to communicate with the storage chamber via the return channel, and in the bubble removal process, the controller is configured to execute not only the first process but also a second process in which the liquid moves from the storage chamber to flow through the supply upstream portion and the supply branching channel by driving the pump with the valve being in the third position.

* * * * *